US008306407B2

(12) United States Patent
Yang et al.

(10) Patent No.: US 8,306,407 B2
(45) Date of Patent: Nov. 6, 2012

(54) HIGH-EFFICIENCY WATER BOILER

(76) Inventors: Shun-Chi Yang, Kaohsiung (TW); Mao-Hsiung Yang, Kaohsiung (TW); Tsung-Chuan Yang, Kaohsiung (TW); Fang-Ming Wu, Kaohsiung (TW); Cheng-Yen Wu, Kaohsiung (TW)

( * ) Notice: Subject to any disclaimer, the term of this patent is extended or adjusted under 35 U.S.C. 154(b) by 550 days.

(21) Appl. No.: 12/647,579

(22) Filed: Dec. 28, 2009

(65) Prior Publication Data

US 2010/0310240 A1 Dec. 9, 2010

(51) Int. Cl.
*F24C 1/00* (2006.01)
*F24C 11/00* (2006.01)

(52) U.S. Cl. ..... 392/308; 392/307; 392/450

(58) Field of Classification Search ..... 392/307, 392/308, 450
See application file for complete search history.

(56) References Cited

U.S. PATENT DOCUMENTS

| | | | | | |
|---|---|---|---|---|---|
| 2,386,949 | A * | 10/1945 | Hayward | ..... | 392/450 |
| 3,665,153 | A * | 5/1972 | Asakawa | ..... | 392/308 |
| 4,173,872 | A * | 11/1979 | Amthor, Jr. | ..... | 62/238.6 |
| 5,190,025 | A * | 3/1993 | Chen | ..... | 126/19.5 |
| 2011/0041781 | A1 * | 2/2011 | Deivasigamani et al. | ... | 122/18.1 |

* cited by examiner

*Primary Examiner* — Thor Campbell
(74) *Attorney, Agent, or Firm* — Alan Kamrath; Kamrath IP Lawfirm, PA

(57) ABSTRACT

A high-efficiency water boiler includes a shell and a heating unit located in the shell. The heating unit includes a heating tank filled with fuel and a heater for heating the fuel. A containing unit includes a container provided around the heating tank. A heat conduction unit includes heat conduction pipes leading to the container from the heating tank to transfer heat to the container from the heating tank. A cooling unit includes a heat exchanger for cooling the fuel going therein from the heating tank. An inlet pipe extends through the heat exchanger and includes an end connected to a leading section of the container so that water can go into the container through the inlet pipe. An outlet pipe is connected to a tailing section of the container so that the water can leave the container through the outlet pipe.

10 Claims, 7 Drawing Sheets

HIGH-EFFICIENCY WATER BOILER

FIELD OF THE INVENTION

The present invention relates to a water boiler and, more particularly, to a high-efficiency water boiler.

BACKGROUND OF THE INVENTION

A water boiler operated on gas, natural gas or diesel is often used in a school, hospital, hotel, office, factory, military camp or the like to provide water for drinking or washing. However, there is always a risk of incomplete combustion that leads to the production of lethal carbon monoxide. Instead, an electric water boiler can be used. There are problems such as a low heating rate and a high thermal loss that causes a problem to the environment.

The present invention is therefore intended to obviate or at least alleviate the problems encountered in the prior art.

BRIEF SUMMARY OF THE INVENTION

It is the primary objective of the present invention to provide a high-efficiency water boiler.

To achieve the foregoing objective, the high-efficiency water boiler includes a shell and a heating unit located in the shell. The heating unit includes a first heating tank filled with fuel and a heater located in the first heating tank for heating the fuel. A containing unit includes a first container provided around the first heating tank. The first container includes a leading section and a tailing section. A heat conduction unit includes a plurality of radial heat conduction pipes leading to the first container from the first heating tank to transfer heat to the first container from the first heating tank. A cooling unit includes a first exchanger for cooling the fuel going therein from the first heating tank. An inlet pipe extends through the first heat exchanger and includes an end connected to the leading section of the first container so that the water can go into the first container through the inlet pipe. An outlet pipe is connected to the tailing section of the first container so that the water can leave the first container through the outlet pipe.

In a preferred form, the heating unit further includes additional heating tanks so that the additional heating tanks and the first heating tank are arranged in a vertical direction and are connected to one another. The containing unit further includes additional containers so that each of the additional containers is provided around a related one of the additional heating tanks and that the additional containers and the first container are connected to one another and that the additional containers are connected between the tailing section of the first container and the outlet pipe. The heat conduction unit includes additional radial heat conduction pipes each leading to a related one of the additional containers from a related one of the additional heating tanks, and at least one longitudinal heat conduction pipe extending any two adjacent ones of the additional heating tanks.

In a most preferred form, the fuel is oil. The water is filled in the first and additional containers.

In another most preferred form, the fuel is oil. The oil is filled in the first and additional containers. The containing unit further includes a water pipe extending through each of the first and additional containers. The water goes through the water pipes. An end of the water pipe in the first container is connected to the inlet pipe and an end of the water pipe in a last one of the additional containers is connected to the outlet pipe.

The present invention will become clearer in light of the following detailed description of illustrative embodiments of this invention described in connection with the drawings.

DESCRIPTION OF THE DRAWINGS

The present invention will be described via detailed illustration of two embodiments referring to the drawings where.

DETAILED DESCRIPTION OF THE INVENTION

Figure 1:
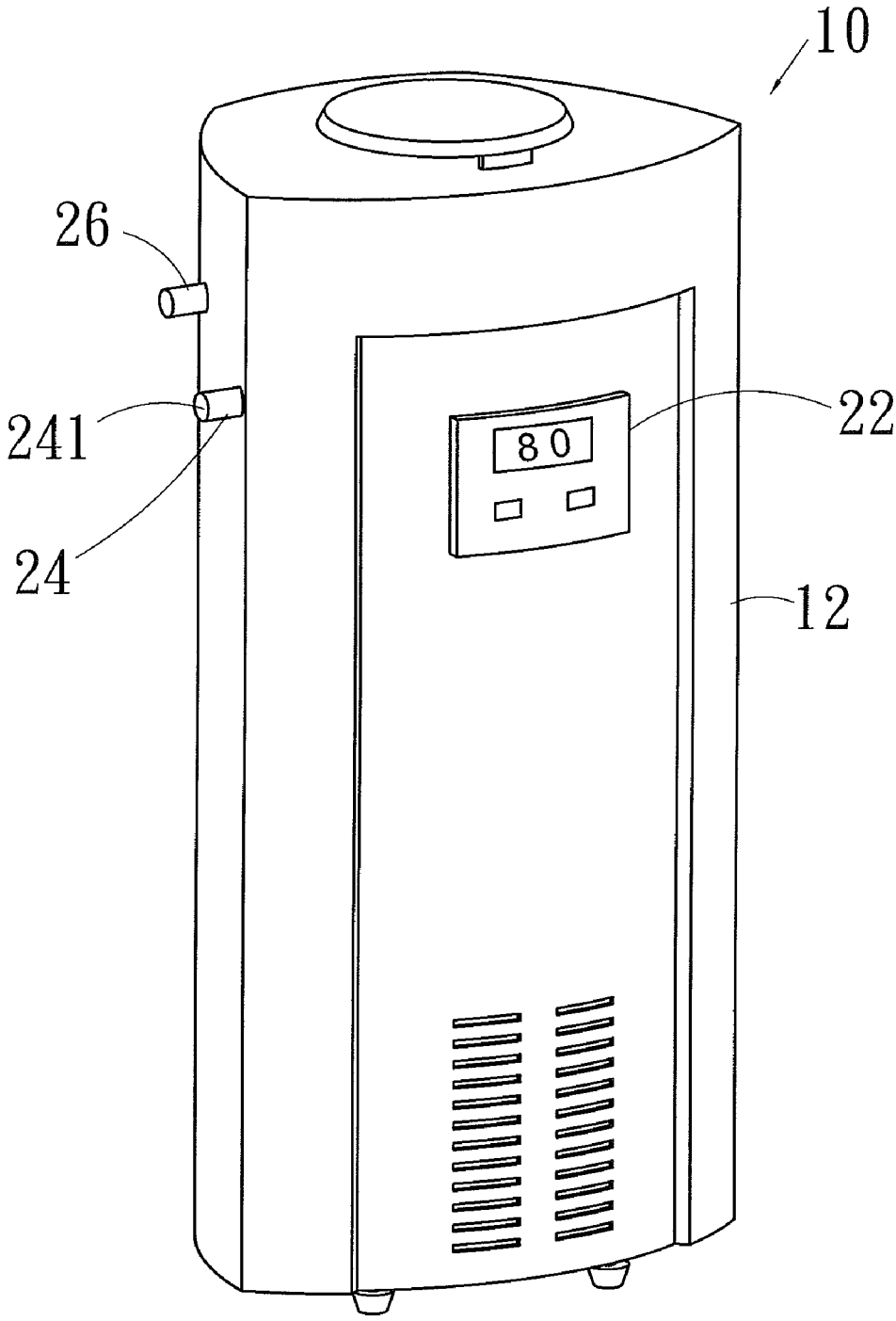
FIG. 1 is a perspective view of a high-efficiency water boiler according to a first embodiment of the present invention.
Figure 2:
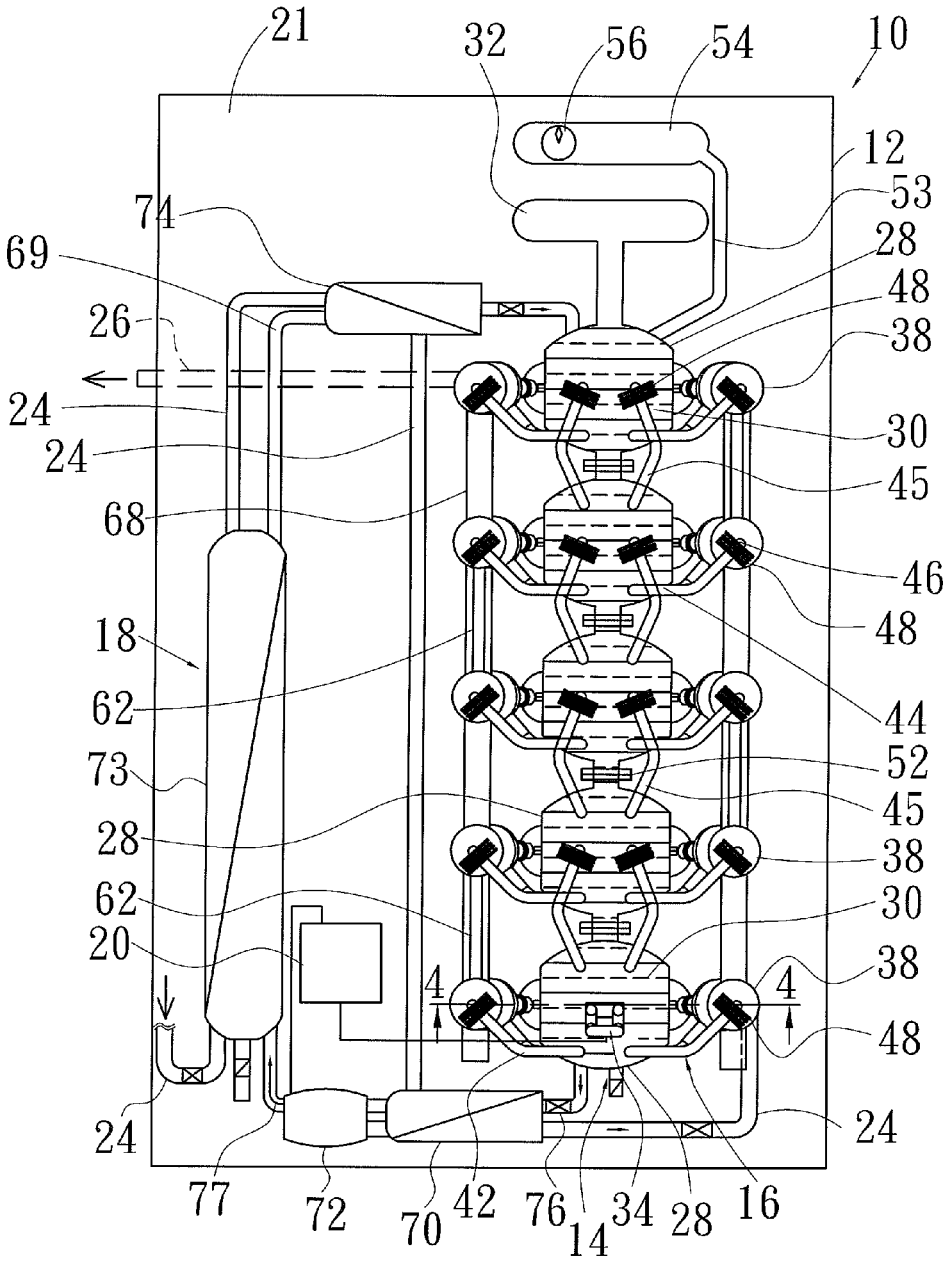
FIG. 2 is a sectional view of the high-efficiency water boiler shown in FIG. 1.
Figure 3:
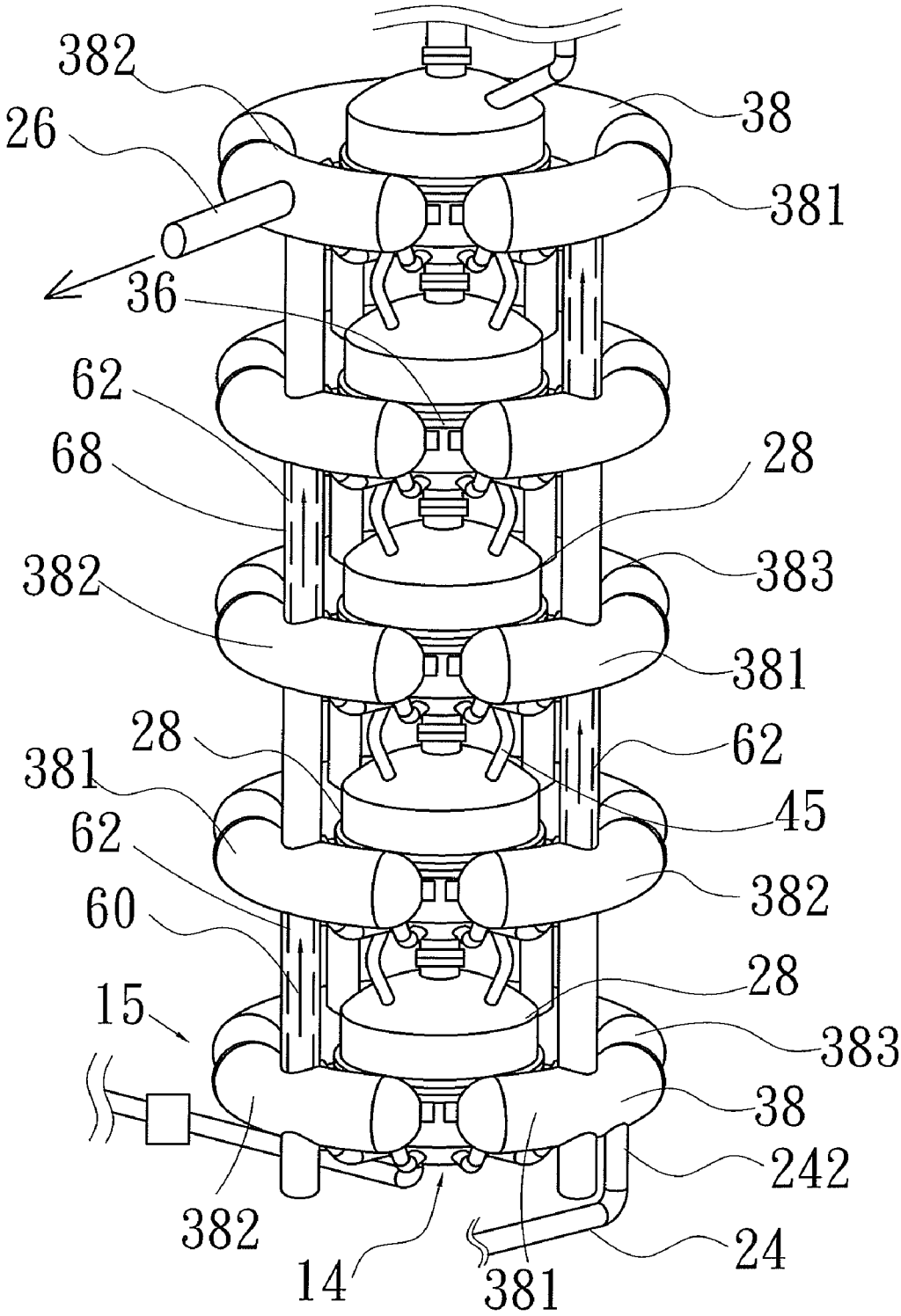
FIG. 3 is a partial, perspective view of the high-efficiency water boiler shown in FIG. 1.
Figure 4:
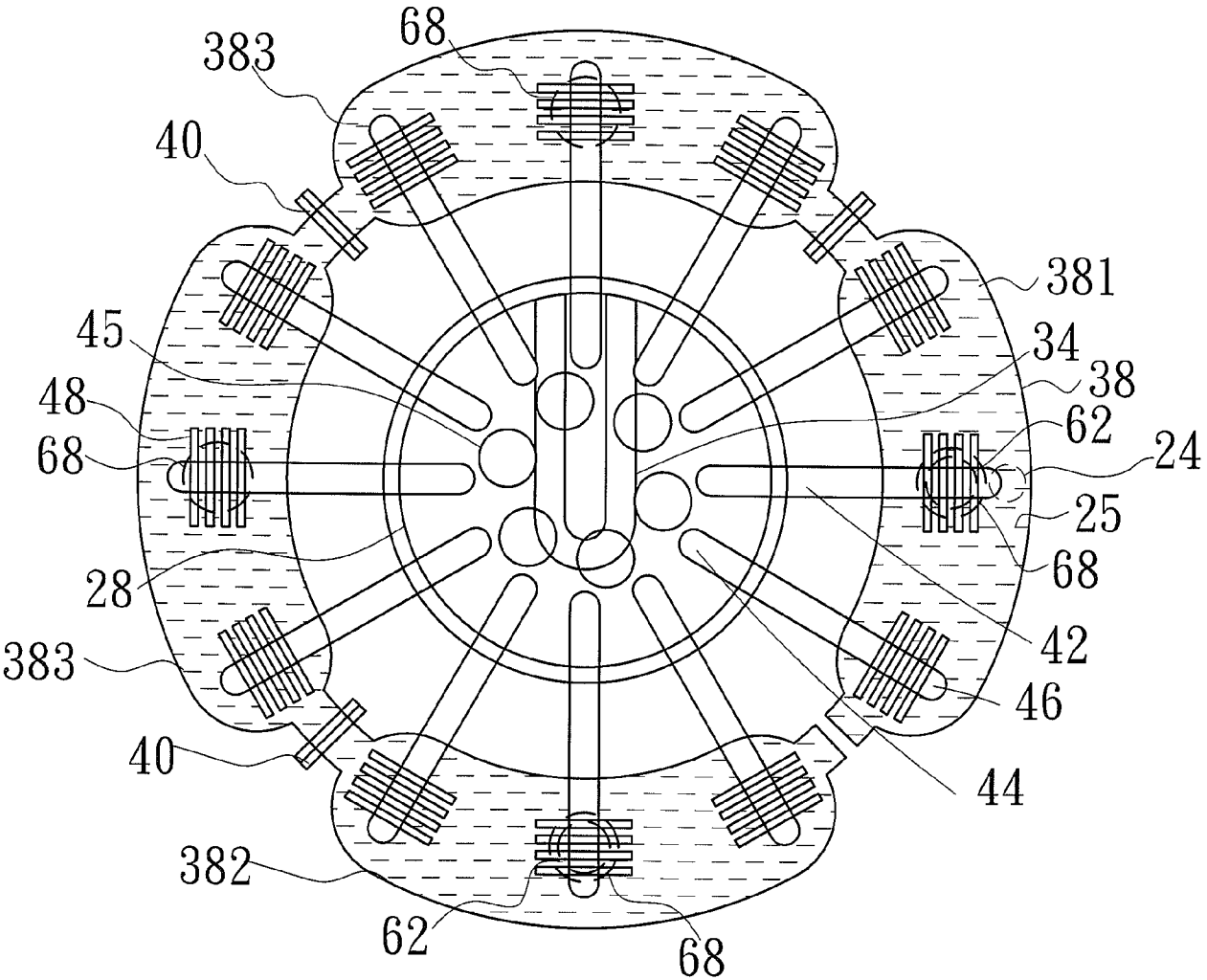
FIG. 4 is a cross-sectional view of the high-efficiency water boiler taken along line 4-4 in FIG. 2.

Referring to FIGS. 1 through 4, a high-efficiency water boiler 10 includes a shell 12, a heating unit 14, a containing unit 15, a heat conduction unit 16, a cooling unit 18, a control unit 20, an inlet pipe 24, and an outlet pipe 26 according to a first embodiment of the present invention. The shell 12 includes a space 21 for containing the heating unit 14, the containing unit 15, the heat conduction unit 16, and the cooling unit 18. The inlet pipe 24 and the outlet pipe 26 are provided on the shell 12. The inlet pipe 24 is in communication with an end of the containing unit 15 while the outlet pipe 26 is in communication with another end of the containing unit 15. Water 25 is transferred into the water boiler 10 through the inlet pipe 24. In the water boiler 10, the water 25 is heated. The water 25 is transferred out of the water boiler 10 through the outlet pipe 26 after it is heated.

The heating unit 14 includes a plurality of heating tanks 28, a fuel tank 32 and a heater 34. The heating tanks 28 are arranged in a vertical direction. Each of the heating tanks 28 includes two halves that are made separately and then joined together. Each of the halves includes a flange 36 connected to the flange 36 of the other half. Thus, the halves are easily joined together. Each of the halves includes another flange 52 connected to the flange 52 of a related one of the halves of another one of the heating tanks 28. Thus, the heating tanks 28 are interconnected. For clarity, the lowermost one of the heating tanks 28 will be called "the first heating tank 28" and the uppermost one of the heating tanks 28 will be referred to as "the last heating tank 28" in the following description.

The fuel tank 32 is connected to the last heating tank 28 so that fuel 30 is filled into the first heating tank 28 from the fuel tank 32. The fuel 30 is preferably oil having an ignition point ranging from about 200 to 1000 degrees Celsius. The heater 34 is located in the first heating tank 28 to heat the fuel 30. The heater 34 is preferably operated on high frequency.

An expansion tank 54 is connected to the last heating tank 28 through an expansion pipe 53. An overflowing portion of the fuel 30, if any, is sent into the expansion tank 54 from the last heating tank 28 when the fuel 30 expands because of heat. A thermometer 56 is provided on the expansion tank 54. The temperature of the fuel 30 is observable from the thermometer 56.

The containing unit 15 includes a plurality of containers 38 arranged in the vertical direction. There are tubes 68 provided between any two adjacent ones of the containers 38 in the vertical direction. Each of the containers 38 is provided around a related one of the heating tanks 28. Each of the containers 38 includes a leading section 381, a tailing section 382 spaced from the leading section 381 in a circumferential direction, and intermediate sections 383 between the leading section 381 and the tailing section 382. Each of the sections 381, 382 and 383 extends in an arc. A joint 40 is provided between any two adjacent ones of the sections 381, 382 and 383. The leading section 381 is not directly connected to the tailing section 382. For clarity, the lowermost one of the containers 38 will be called "the first container 38" while the uppermost one of the containers 38 will be called "the last container 38" in the following description. The sections 381 and 382 of the first container 38 are arranged counterclockwise. The sections 381 and 382 of the second container 38 are arranged clockwise. The sections 381 and 382 of the third container 38 are arranged counterclockwise. The sections 381 and 382 of the other containers 38 are similarly arranged. The leading section 381 of the first container 38 is connected to the inlet pipe 24. The tailing section 382 of each container 38 is connected to the leading section 381 of the next container 38 via a passageway 62 defined in one of the tubes 68. Thus, the water 25 can go from each container 38 into the next container 38 in a direction indicated with an arrow head 60 within FIG. 3. The tailing section 382 of the last container 38 is connected to the outlet pipe 26. The outlet pipe 26 includes a section located in the shell 12 and another section in the form of a faucet located outside the shell 12.

The heat conduction unit 16 includes a plurality of radial heat conduction pipes 42 and longitudinal heat conduction pipes 45. Each of the heat conduction pipes 42 is a metal tube that stands high temperature. The heat conduction pipes 42 contain heat transfer medium such as superconducting liquid. Each of the heat conduction pipes 42 includes a first section 44 with a closed end received in a related one of the heating tanks 28 and a second section 46 with a closed end received in a related one of the sections 381, 382 and 383 of a related one of the containers 38. A plurality of fins 48 is formed on the second section 46 of each of the heat conduction pipes 42. The first section 44 extends horizontally and the second section 46 extends from the first section 44 upwardly by an angle of 30 degrees, reducing the volume of the heat conduction pipes 42 and increasing the performance of the heat conduction pipes 42. The heat conduction pipes 45 are metal tubes that stand high temperature like the heat conduction pipes 42. The heat conduction pipes 45 contain heat transfer medium such as superconducting material. Each of the heat conduction pipes 45 includes a closed upper end received in a related one of the heating tanks 28 and a closed lower end received in an adjacent one of the other heating tanks 28. A plurality of fins 48 is formed on each of the heat conduction pipes 45.

The cooling unit 18 includes a fuel pipe 69, a motor 72, a first heat exchanger 70, a second heat exchanger 73 and a third heat exchanger 74. The fuel pipe 69 directly leads to the last heating tank 28 from the first heating tank 28 without extending through the other heating tanks 28. The motor 72 is connected to the fuel pipe 69. Thus, the motor 72 can be actuated to pump the fuel 30 into the last heating tank 28 from the first heating tank 28 through the fuel pipe 69. The first heat exchanger 70 is provided between the first heating tank 28 and the motor 72 along the fuel pipe 69. A check valve 76 is provided between the first heating tank 28 and the first heat exchanger 70. The second heat exchanger 73 and the third heat exchanger 74 are subsequently arranged between the motor 72 and the last heating tank 28 along the fuel pipe 69. The motor 72 can be used to pump the fuel 30 to go through the heat exchangers 70, 73 and 74 as indicated with an arrow head 77 within FIG. 2.

The control unit 20 includes an interface 22 located on the shell 12. The interface 22 is operable to set a value of temperature of the water 25. Except the interface 22, the control unit 20 is located in the shell 12. The control unit 20 is electrically connected to the heater 34 of the heating unit 14 and the motor 72 of the cooling unit 18. Via operating the interface 22, the control unit 20 is used to turn on and off the heater 34 and the motor 72 to heat the water 25 so that the temperature of the water 25 reaches but does not exceed the set value.

The inlet pipe 24 includes a first section 241 located outside the shell 12 and a second section 242 located in the shell 12. The first section 241 of the inlet pipe 24 is connected to a water reservoir for example. The second section 242 of the inlet pipe 24 extends through the heat exchangers 73, 74 and 70 and is connected to the leading section 381 of the first container 38.

In operation of the water boiler 10, the cold water 25 is sent into the water boiler 10 through the inlet pipe 24. The water 25 goes through the heat exchangers 73, 74 and 70, and gets preheated. The water 25 goes upwardly through the containers 38 via passageway 62. While going through the containers 38, the water 25 is heated in the containers 38 which receive heat from the heating tanks 28 through the heat conduction pipes 42. Thus, the water 25 can efficiently be heated. When the temperature of the water 25 in the containers 38 reaches the set value, the control unit 20 actuates the motor 72 to pump the fuel 30 in the heating tanks 28 into the first heat exchanger 70, the second heat exchanger 73, and the third heat exchanger 74 to reduce the temperature so that the temperature of the water 25 does not exceed the set value. Finally, the hot water 25 is transferred out of the water boiler 10 through the outlet pipe 26.

Figure 5:
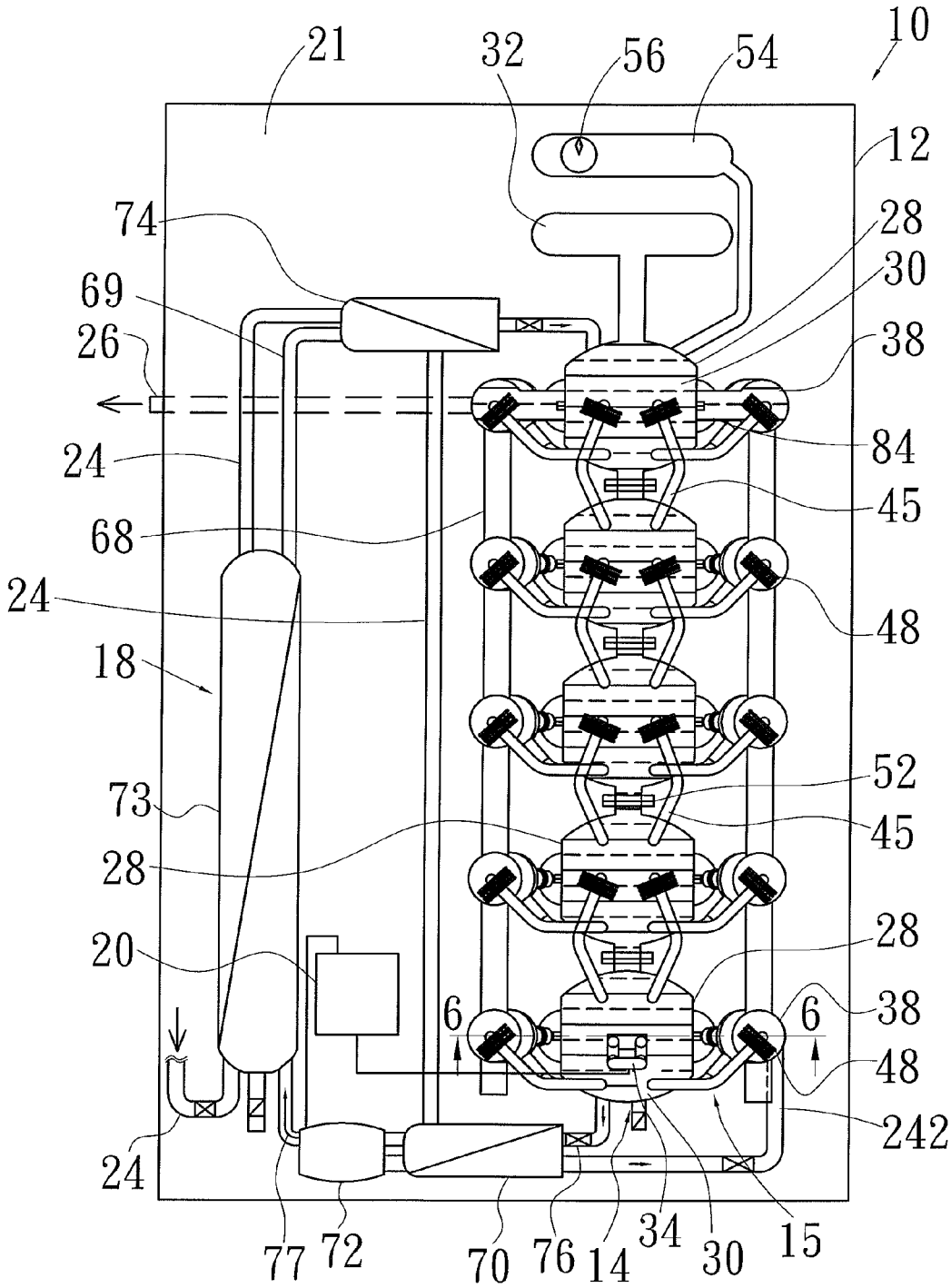
FIG. 5 is a sectional view of a high-efficiency water boiler according to a second embodiment of the present invention.
Figure 6:
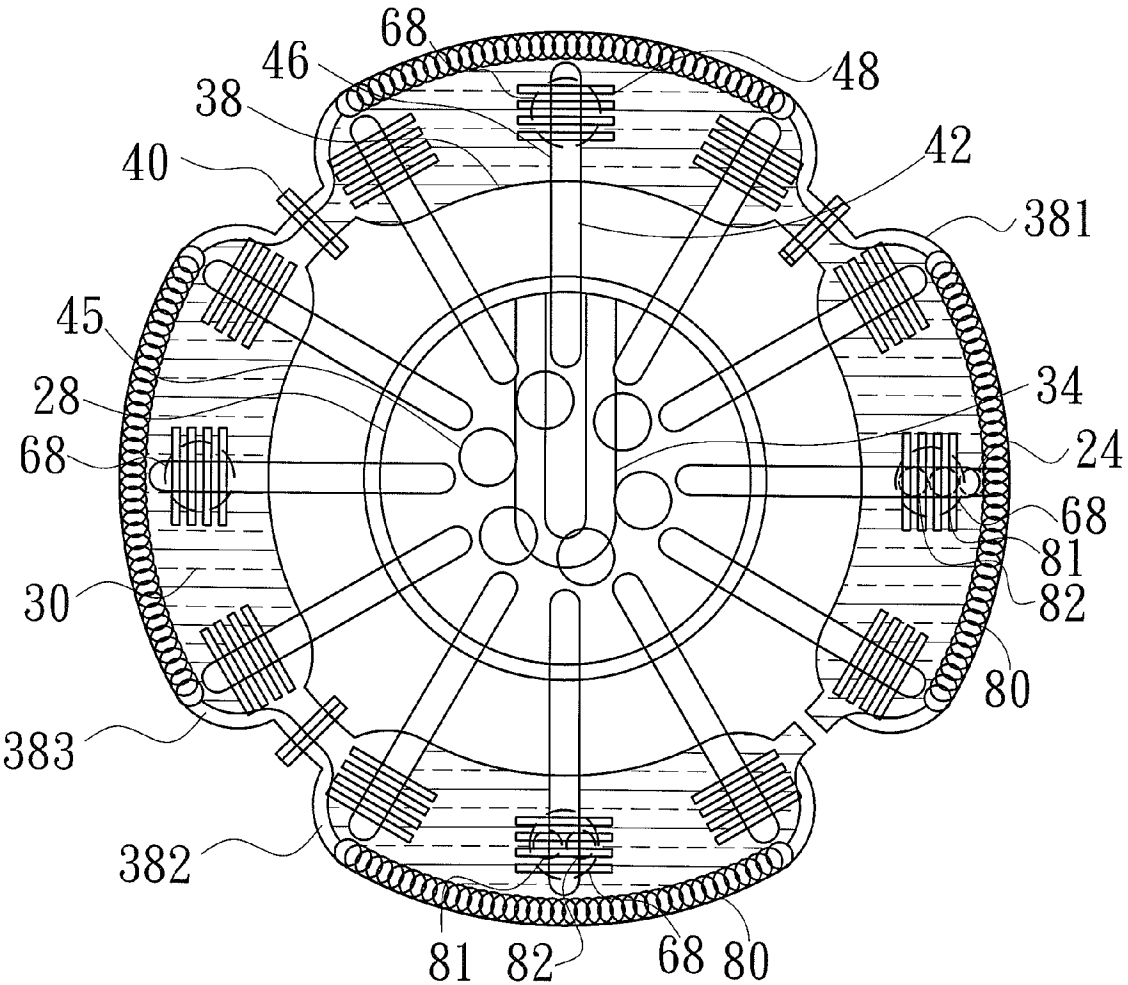
FIG. 6 is a cross-sectional view of the high-efficiency water boiler taken along line 6-6 in FIG. 5.
Figure 7:
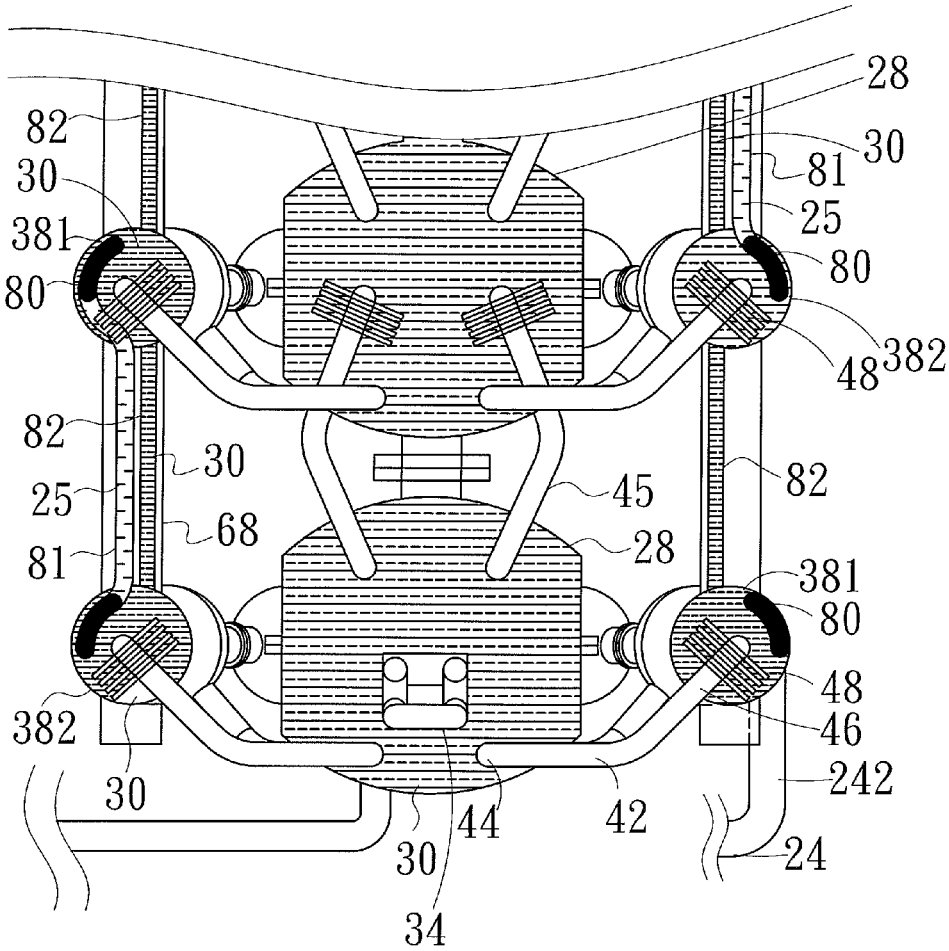
FIG. 7 is a partial, sectional view of the high-efficiency water boiler shown in FIG. 5.

Referring to FIGS. 5 to 7, there is shown a high-efficiency water boiler 10 according to a second embodiment of the present invention. The second embodiment is like the first embodiment except two things. Firstly, the containers 38 are filled with the fuel 30, not the water 25. Any two adjacent ones of the containers 38 are interconnected via conduits 82. The last heating tank 28 is connected to the last container 38 through at least one conduit 84. Thus, the fuel 30 can go into the last container 38 from the last heating tank 28 via the conduit 84, and go into the first container 38 from the last container 38 via the conduits 82.

Secondly, there is a water pipe 80 located in each of the containers 38. The water pipe 80 is a helical pipe. The water pipe 80 includes a first end located in the leading end 381 of each of the containers 38 and a second end located in the tailing section 382 of each of the containers 38. With respect to the first container 38, the first end of the water pipe 80 is connected to the second end 242 of the inlet pipe 24 while the second end of the water pipe 80 is connected to the first end of the water pipe 80 of an adjacent one of the other containers 38. A passageway 81 interconnects any two adjacent ones of the water pipes 80. The second end of the water pipe 80 of the last container 38 is connected to the outlet pipe 26. Thus, the water 25 can go through each of the containers 38 through the related water pipe 80, and go between the containers 38 through the passageways 81, and go out of the water boiler 10 through the outlet pipe 26. The passageways 81 are defined in the tubes 68.

In operation, the heat conduction pipes 42 transfer heat between each of the heating tanks 28 and a related one of the containers 38. The heat conduction pipes 45 transfer heat between any two adjacent ones of the heating tanks 28. The fuel 30 efficiently heats the water 25 within the containers 38. Thus, a little fuel can be used to produce a lot of hot water. To boil a same amount of water, the water boiler 10 of the present invention consumes a smaller amount of energy and produces a smaller amount of carbon dioxide than the prior art.

The present invention has been described via the detailed illustration of the embodiments. Those skilled in the art can derive variations from the embodiments without departing from the scope of the present invention. For example, the heater 34 can be operated on microwave instead of the high frequency. Moreover, the inlet pipe 24 can extend some of the heat exchangers, not all. Therefore, the embodiments shall not limit the scope of the present invention defined in the claims.

The invention claimed is:

1. A high-efficiency water boiler comprising:

a shell;

a heating unit located in the shell, wherein the heating unit includes a first heating tank filled with fuel and a heater located in the first heating tank for heating the fuel;

a containing unit including a first container provided around the first heating tank, wherein the first container includes a leading section and a tailing section;

a heat conduction unit including a plurality of radial heat conduction pipes leading to the first container from the first heating tank to transfer heat to the first container from the first heating tank;

a cooling unit including a first exchanger for cooling the fuel going therein from the first heating tank;

an inlet pipe extending through the first heat exchanger and including an end connected to the leading section of the first container so that the water can go into the first container through the inlet pipe; and an outlet pipe connected to the tailing section of the first container so that the water can leave the first container through the outlet pipe.

2. The high-efficiency water boiler according to claim 1, wherein:

the heating unit further includes additional heating tanks so that the additional heating tanks and the first heating tank are arranged in a vertical direction and are connected to one another;

the containing unit further includes additional containers so that each of the additional containers is provided around a related one of the additional heating tanks and that the additional containers and the first container are connected to one another and that the additional containers are connected between the tailing section of the first container and the outlet pipe; and the heat conduction unit includes additional radial heat conduction pipes each leading to a related one of the additional containers from a related one of the additional heating tanks, and at least one longitudinal heat conduction pipe extending any two adjacent ones of the additional heating tanks.

3. The high-efficiency water boiler according to claim 2, wherein the fuel is oil, wherein the water is filled in the first and additional containers, wherein the radial and longitudinal heat conduction pipes are metal pipes filled with superconducting material.

4. The high-efficiency water boiler according to claim 2, wherein the fuel is oil, wherein the oil is filled in the first and additional containers, wherein the containing unit further includes a water pipe extending through each of the first and additional containers, wherein the water goes through the water pipes, wherein an end of the water pipe in the first container is connected to the inlet pipe and an end of the water pipe in a last one of the additional containers is connected to the outlet pipe, wherein the radial and longitudinal heat conduction pipes are metal pipes filled with superconducting material.

5. The high-efficiency water boiler according to claim 4, wherein the water pipes are helical pipes, wherein the water pipe in the first container is connected to the inlet pipe within the first section while the water pipe in the last one of the additional containers is connected to the outlet pipe within the second section.

6. The high-efficiency water boiler according to claim 4, wherein the cooling unit further includes:

a fuel pipe leading from the first heating tank to the last one of the additional heating tanks;

a motor connected to the fuel pipe, wherein the first exchanger is provided between the motor and the first heating tank along the fuel pipe; and a second heat exchanger provided between the motor and the last one of the heating tanks, wherein the motor can be energized to pump the fuel into the last one of the additional heating tanks from the first heating tank through the first and second heat exchangers, wherein the inlet pipe leads to the first container through the first and second heat exchangers.

7. The high-efficiency water boiler according to claim 6, further comprising a control unit electrically connected to the heater and the motor to turn on and off the heater and the motor, wherein the cooling unit includes a third heat exchanger provided between the second heat exchanger and the last one of the additional heating tanks along the fuel pipe, wherein the inlet pipe leads to the leading section of the first container through the second, third and first heat exchangers.

8. The high-efficiency water boiler according to claim 6, further comprising a control unit electrically connected to the heater and the motor to turn on and off the hater and the motor, wherein the heater is operated on high frequency.

9. The high-efficiency water boiler according to claim 3, wherein each of the radial heat conduction pipes includes a first section in a related one of the heating tanks and a second section in a related one of the containers, with the second section extending from the first section at an angle of 30 degrees.

10. The high-efficiency water boiler according to claim 5, wherein each of the radial heat conduction pipes includes a first section in a related one of the heating tanks and a second section in a related one of the containers, with the second section extending from the first section at an angle of 30 degrees.

* * * * *